United States Patent [19]

Wallot

[11] 4,019,102

[45] Apr. 19, 1977

[54] SUCCESSIVE APPROXIMATION FEEDBACK CONTROL SYSTEM

[75] Inventor: George P. Wallot, Fort Wayne, Ind.

[73] Assignee: General Electric Company, Carmel, Ind.

[22] Filed: Oct. 16, 1975

[21] Appl. No.: 622,960

[52] U.S. Cl. ..... 361/225; 323/20; 355/14

[51] Int. Cl.[2] ..... G03G 13/02

[58] Field of Search ..... 307/235 C; 317/262 A, 317/262 E; 318/604, 605, 609, 610; 323/1, 4, 16, 19, 20; 328/151; 355/14

[56] References Cited

UNITED STATES PATENTS

| | | | |
|---|---|---|---|
| 3,864,554 | 2/1975 | Chevalier et al. | 318/609 X |
| 3,893,010 | 7/1975 | Ishizawa et al. | 318/609 X |
| 3,939,390 | 2/1976 | Pomella et al. | 318/604 |

*Primary Examiner*—A. D. Pellinen

[57] ABSTRACT

A feedback control system for use in an electrostatographic apparatus capable of, by successive approximation, approaching a value of charge on an electrostatographic imaging surface which is in correct proportion to a reference voltage thereby to result in near zero circuit error. A predictor circuit samples, during a sample period, the reference voltage, the charge on the imaging surface and the output of a first, conventional feedback loop to produce a corrected reference voltage value for the loop. During the sample period, this corrected reference is stored in first memory while a second memory receives a constant input reference for feeding to the loop. At sample end, the constant input reference is disconnected from the second memory and the contents of the first memory are fed to the second memory thereby providing the corrected reference voltage to the loop. When the apparatus is operational and producing copies, the process repeats itself thereby keeping the charge level close to the reference ideal.

21 Claims, 4 Drawing Figures

30
20
Σ1
Σ2
Σ3
G1
G2
AS1
AS2
-5.6 V. REF.
CHG. SENS. SET
FET SW.
INPUT SLOPE
FALL
RISE
+6.2 V.
-6.2 V.
COM
TP

SUCCESSIVE APPROXIMATION FEEDBACK CONTROL SYSTEM

BACKGROUND OF THE INVENTION

I. Field of the Invention

The present invention relates to feedback control systems, and particularly, to a successive approximation control circuit for maintaining a set value of photoreceptor charge in an electrostatographic photo-copier thereby to produce uniform copies.

II. Description of the Prior Art

In many photo-copier applications, the copying process involves: (1) depositing a uniform layer of charge at a specified charge density on a surface, the surface being of the type which discharges when exposed to light; (2) exposing the surface to light; (3) attracting a supply of dark powderlike printing material to the charge image remaining on the surface after exposure to light; (4) transforming the powder image to paper if the charged surface was not initially sensitized paper; (5) bonding the powder into the paper, thus making a permanent copy.

The scope of this invention deals with step (1) of the above process: i.e., depositing charge on a photo-sensitive surface hereinafter referred to as a photoreceptor, or PR.

The PR is usually charged by passing a wire, a charge corotron, maintained at high voltage, near and over the surface thereof. This high voltage causes a current to flow thus charging the distributed capacitance of the PR surface.

The prior art has produced such power supplies, i.e., charge corotron power supplies, which are essentially high voltage, DC constant current regulated devices. The prior art, however, assumes that the deposited charge, once set, will remain at the correct level for producing uniform copies. Normally, the method is to set a fixed current; a better procedure is to manually adjust the power supply until the proper voltage (proportional to PR charge) is registered on an electrometer positioned near the PR but not at the same location as the charge corotron. Because the devices are not at the same place on the PR at the same times, a trial and error method is used involving: setting current; rotating the PR; checking electrometer voltage; and repeating until the proper voltage results. Unfortunately, this voltage would drift as the copy machine is used causing copy quality to degrade. The fallacy in the assumption that deposited charge will remain at the correct level is, at least in part, due to the fact that PR capacitance has a leakage component which is very sensitive to temperature and other influencing factors. It is this increase in leakage that causes less charge to appear on the PR at the time of powder pickup and which results in light copies.

It is desirable therefore to provide a system capable of self adjustment to compensate for changing values of a sensed variable which can not be controlled at the same time they are being sensed.

Accordingly, it is an object of the present invention to provide a sample data control circuit capable of maintaining a set value of PR charge in a photocopier regardless of the non-linearity of the PR capacitance, or leakage thereof, as affected by environmental changes.

SUMMARY OF THE INVENTION

In accordance with the present invention, there is provided a feedback control system. The system includes a first feedback loop having an input reference, a summing junction, a forward transfer function, an output yielding a controlled variable, and a feedback transfer function. A separate transfer function is provided having an input connected to the output of the first feedback loop and producing a system output controlled variable. Also included is a system input reference. A predictor means is provided for sampling the system output controlled variable, the system input reference and the first feedback loop controlled variable to produce a corrected input reference to the first feedback loop to result in a shift in the first feedback loop output and a corresponding shift in system output controlled variable that will, by successive approximation, approach a value which is in correct proportion to the system input reference thereby resulting in a near zero system error.

DESCRIPTION OF THE PREFERRED EMBODIMENT

Figure 1:
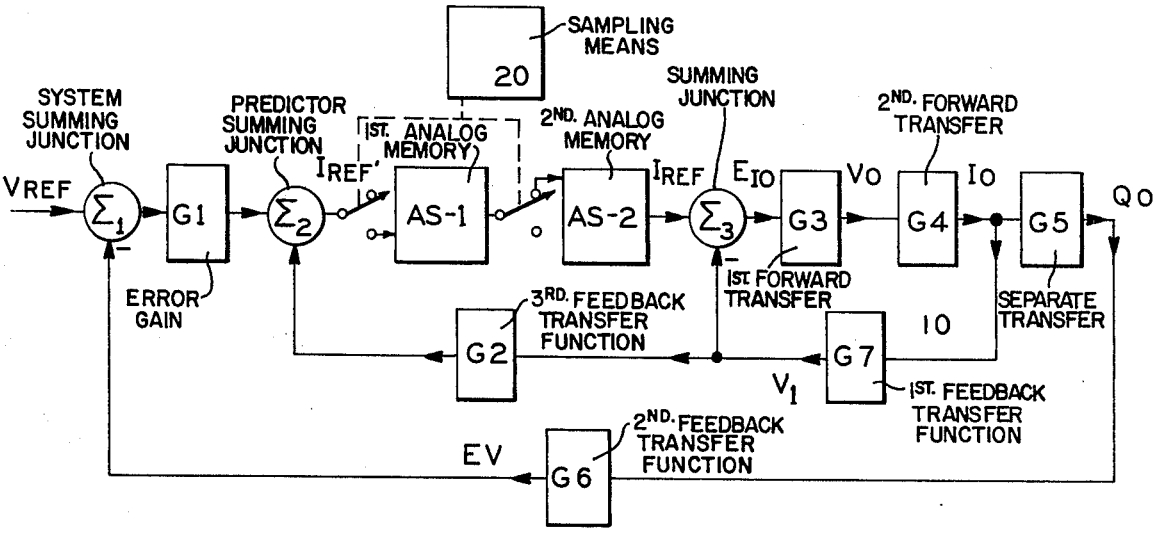
FIG. 1 is function block diagram of the feedback control system of the present invention.

In accordance with the present invention and referring now to FIG. 1, there is shown a functional block diagram of the feedback control system of the present invention. Included is a conventional or first feedback loop 10. First feedback loop 10 comprises: input reference $I_{ref}$; summing junction Σ 3; a first forward transfer function G3 having as its input the input error signal Eio and an output $V_o$; a second forward transfer function G4 having as an input $V_o$ and an output yielding a controlled variable $I_o$; and a first feedback transfer function G7 with an input $I_o$ and an output V1. Also included is a separate transfer function G5 with an input $I_o$ and an output $Q_o$; G5 has discontinuities and is affected by environmental changes. Output $Q_o$ is the system output controlled variable: that which is to be controlled. $V_{ref}$ is the system input reference and has as a value the ideal for the system output controlled variable $Q_o$. A predictor means is included for sampling the system output controlled variable $Q_o$, the system input reference $V_{ref}$ and the first feedback loop controlled variable $I_o$ to produce a corrected input reference $I_{ref}$, to the first feedback loop 10 to result in a shift in the first feedback loop output $I_o$ and a corresponding shift in system output controlled variable $Q_o$ that will by successive approximation approach a value which is in direct proportion to the system input reference $V_{ref}$ thereby resulting in near zero system error. The predictor means includes a system summing junction Σ 1 having as its summing input $V_{ref}$, a second feedback transfer function G6 having as its input the system output controlled variable $Q_o$ and as its output, EV, a signal proportional to $Q_o$, connected to a substracting input of system summing junction Σ 1. The predictor means also includes transfer function G1 and a third feedback transfer function G2 outputting to a predictor summing junction Σ 2. Also included in the feedback control system is a first analog memory AS1 which receives and holds corrected input reference $I_{ref'}$ from the predictor means during a sample period. A second analog memory AS2 receives and passes a non time-varying input reference to the first feedback loop during a sample period. At sample end, second memory AS2 receives and passes to the first feedback loop the corrected input reference $I_{ref'}$ from first memory AS1.

A sampling means 20 is provided for gating the connected input reference $I_{ref'}$ into first memory AS1 during the sample period while holding the output of second memory AS2 constant. At sample period end, the sampling means 20 disconnects the non time-varying input reference from second memory AS2 while gating the contents of first memory AS1, the corrected input reference $I_{ref'}$, into second memory AS2. Sampling means 20 also includes switch means: for disconnecting the predictor means from the first memory AS1; for transferring the contents of AS1, $I_{ref'}$, into second memory AS2; and, for disconnecting the non time-varying input reference from second memory AS2.

The predictor means configuration uses linear approximation in an analog computing scheme to calculate the signal $I_{ref'}$ to be used as a new $I_{ref}$ at the end of the sample gate. The analog computation scheme uses the present value of $I_{ref}$ and $Q_o$, transfer function G7, G6, G2 and G1 and summing junction Σ 1 and Σ 2 during the sample period to compute and store in first analog memory AS1 the new $I_{ref'}$. The equation for $I_{ref'}$ is easily derived from FIG. 1: $I_{ref'} = [V_{ref} - (Q_o \times G6)]\, G1 + I_o \times G7 \times G2$. G1 is the error gain and G2 is required to make the polarities correct.

Second analog memory AS2 is capable of holding $I_o$ constant during the sample period. The switch means are poled such that during the sample period, $I_{ref'}$ is fed into first analog memory AS1 while second analog memory AS2 input is open thus holding $I_{ref}$ at the value prior to the sample period. The switch means are also poled so that during the rest of the period, as seen in FIG. 1, first analog memory AS1 has its input open, thus holding the value of $I_{ref'}$ at the end of sample, and its output connected to the input of second analog memory AS2 causing the contents of AS1 to be passed into AS2 and allowing the entire loop to shift and hold at a new $I_{ref}$ equal to $I_{ref'}$ at the end of the sample.

Figure 2:
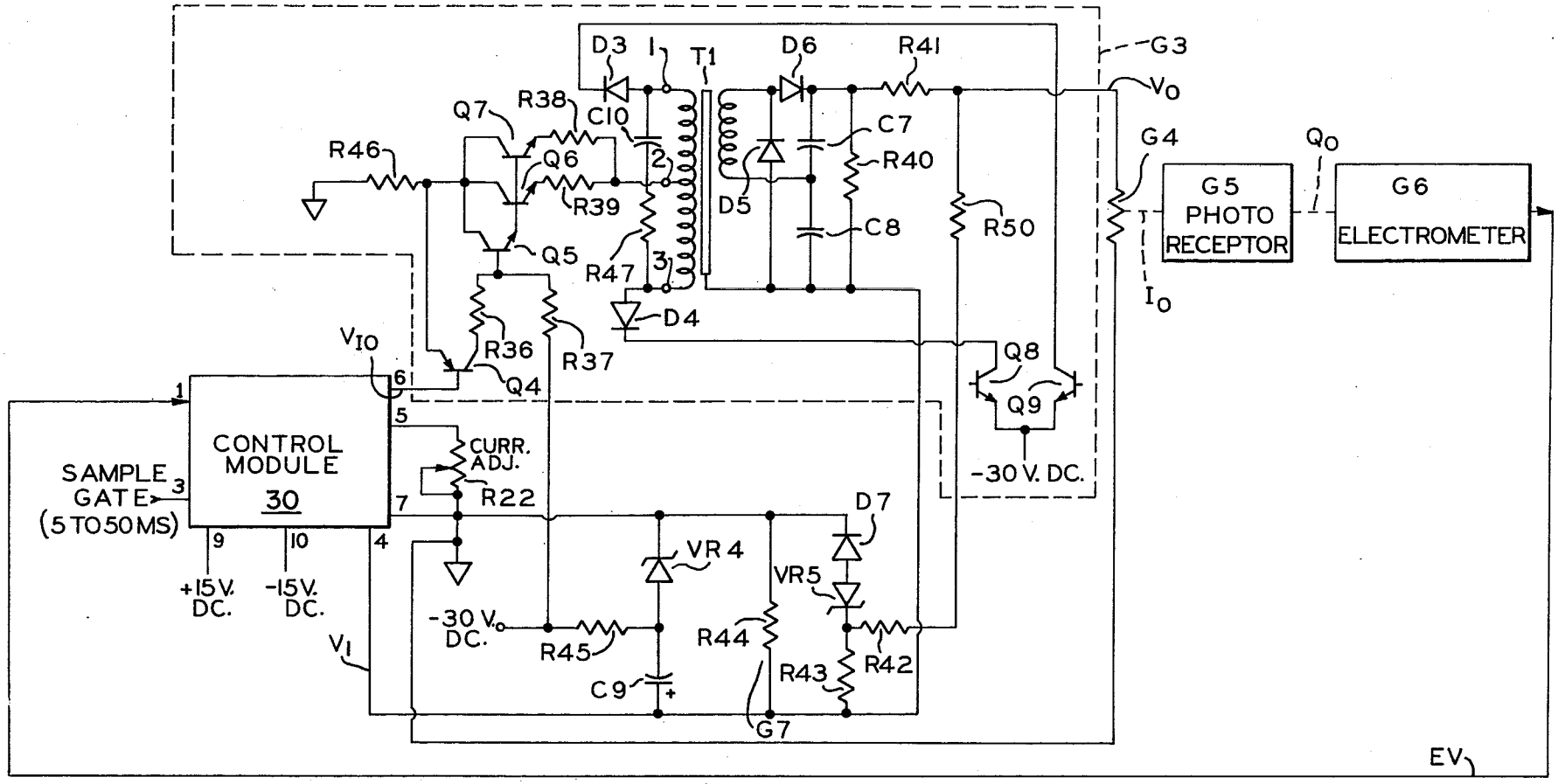
FIG. 2 is a schematic representation of the preferred embodiment of the present invention.
Figure 3:
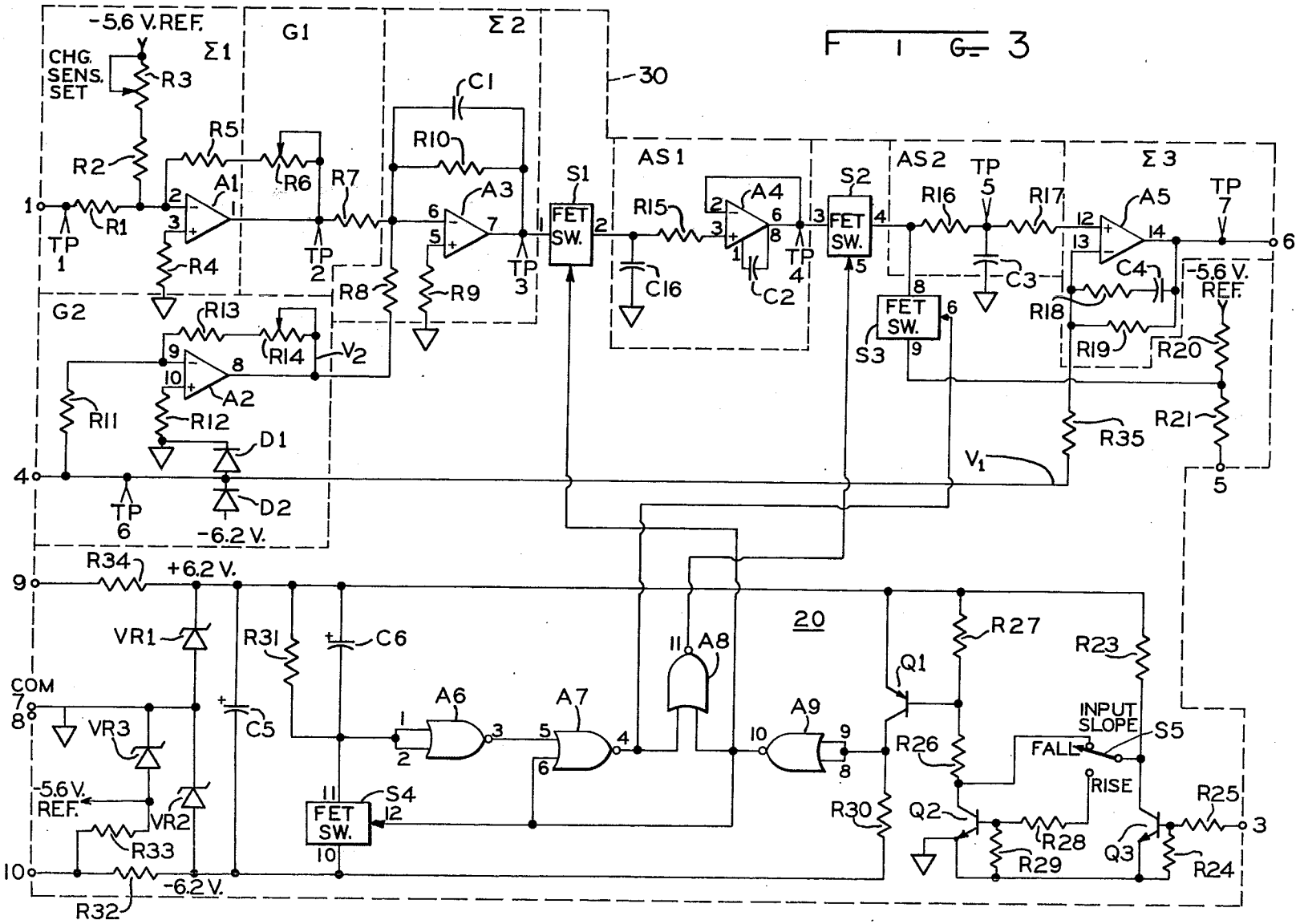
FIG. 3 is a detailed schematic diagram of the charge control module shown in block form in FIG. 2.

Referring now to FIG. 2, there is shown in detailed schematic form the preferred embodiment of the feedback control system of the present invention as applied to use as a feedback control circuit in an electrostatographic apparatus, a photocopier. Included is a charge control module 30, the details of which are shown in FIG. 3 and which will be discussed hereinafter. Also included is first forward transfer function G3 which includes a polarity inverter and a high frequency DC to DC link, feedback transfer function G7 (charge current sensor) and provision for returning an auxiliary current component (shield current) to the circuit without being sensed with the transfer function G5 (moving electrostatographic imaging surface, the photoreceptor - PR) current $I_o$. Also shown are a means for providing short circuit current limiting of all output current to a safe level. Operation of the circuit of FIG. 2 will now be discussed.

A minus 30 volt DC power source (not shown) is available for bias and step-up to high voltage. Depending upon conditions presented to the charge control module 30 by the second feedback transfer function, electrometer G6 input and the current sensor G7, a voltage appears on the output pin 6 of the module setting the voltage at the center tap 2 of a step-up transformer T1 somewhere between zero and minus 30 volts DC. This is accomplished by the use of an amplifier configuration comprised of transistors Q4, Q5, Q6, Q7, resistors R46, R36, R37, R38 and R39. A pair of inverter switching transistors Q8 and Q9 (capable of being alternately switched by a complementary set of 20 KHz square wave signals) draws terminals 1 and 3 of step-up transformer T1 near minus 30 volts through isolation diodes D3 and D4. Through the action of step-up transformer T1, there is provided a variable, high voltage, high frequency AC signal to a full-wave voltage-doubler circuit comprising diodes D5, D6, and capacitors C7 and C8 thus providing high voltage DC output across bleeder resistor R40. A surge resistor R41 is placed in series with the output to limit current should the output be shorted. The foregoing makes up forward transfer function G3. The output voltage $V_o$ is applied to a non-linear load charging means, charge corotron G4, the second forward transfer function.

It is the corotron that deposits charge on the moving photoreceptor G5 (here a rotating drum) and returns the photoreceptor current to signal ground. Another component of corotron load current, shield current (does not contribute to photoreceptor charging), must be kept separate from photoreceptor current $I_o$—the regulated quantity. This is accomplished by returning shield current (shield load shown as resistor $R_{50}$) to the common side of transformer T1 through resistor R42 and R43, with zener diode VR5 normally reverse biased below its zener voltage. PR current develops a negative sense voltage by returning to transformer T1 common through resistor R44 (forming a part of first feedback transfer function G7, a charge current sensing means), thus providing a feedback signal $V_1$ to the charge control module 30 through pin 4. The charge control module 30 then determines what output is needed to cause the output current to assume a value such that PR current through resistor R44 generates the proper value of feedback voltage to satisfy the current reference signal inside the module.

A frequency compensation network comprising zener diode VR4, capacitor C9 and resistor R45 provides stabilization for the control loop. Should excessive shield current result due to an abnormal load, zener diode VR5 will break down and start returning a part of shield current to signal ground through diode D7. This current adds to PR current causing total output current to be limited to a safe value. Resistor R47 and capacitor C10 are placed across the primary of transformer T1 to reduce ringing of the high voltage AC signal on the secondary winding of the transformer.

By the present invention, the need for manual control in a photocopier to adjust copy contrast is eliminated by using a successive approximation control circuit as shown in FIG. 2 to maintain a desired value of photoreceptor (PR) charge regardless of the non-linearity of the PR capacitance as affected by environmental changes. Upon turn on, the circuit, in accordance with the present invention, regulates output current to a preset level much as does the prior art. When the copy process begins, a position sensing mechanism forming a portion of sampling means 20 provides a sample gate signal that activates mode circuitry to change from a conventional, constant current mode to a charge-sensing mode condition. Since the charge pattern on the PR is not normally continuous (i.e., has breaks, holes, etc. by design) this signal also signifies that the data sensed by the electrometer G6, a device for converting charge to a proportional voltage, is valid for comparison to a circuit reference voltage $V_{ref}$. At the end of the sample interval, a relatively short period as compared to the time needed to produce a copy, the circuitry modifies the output current in such a magnitude and direction as to cause a more nearly correct charge to be placed on the PR. With each successive copy, the PR charge current is changed if an error in charge level is detected, thereby causing the charge to remain quite close to the desired level. Should the process stop for a period greater than that required to make several continuous copies, the mode timer will time out and cause the circuit to revert to the constant current mode. FIG. 1 shows the feedback control system in the charge sensing mode; to convert to constant current mode, the input to second analog memory AS2 is disconnected from the output of first analog memory AS1 and is instead connected to a non time-varying value of reference, as will be discussed hereinafter.

Referring now to FIG. 3, there is shown by schematic representation, the electrical circuitry of charge control module 30. Those portions of the functional block diagram of FIG. 1 which are included in charge control module 30 are: Σ 1, G1, Σ 2, G2, AS1, AS2, Σ 3. In addition, charge control module 30 includes four other main parts; (1) a current or charge mode control section; (2) a sample gate processing section including pulse steering logic; (3) a timer section; and (4) a bias and reference power supply.

Starting with the bias and reference power supply section a supply of plus and minus 15 volts DC (not shown) is available at pins 9 and 10 of the module for conversion to plus and minus 6.2 volts DC by conventional shunt regulator circuits comprised of resistor R34, zener diode VR1, resistor R32, and zener diode VR2. A supply of minus 5.6 volts DC for reference purposes is derived from the minus 15 voltage DC input by a shunt regulator circuit comprising resistor R33 and zener diode VR3. Capacitor C5 is used to store energy to provide a low impedance supply of voltage for the current spikes required by the switching transients of amplifiers A6 through A9.

The sample gate processing section provides an option, through input slope switch S5, for positive value sample gate signals applied to pin 3 that are either normally low or normally high. Switch S5 is shown in the "fall" slope position indicating that the sample gate will momentarily fall from a plus value to a near zero volt value and then return to the plus value. Sholud the opposite be required, such as for laboratory tests, changing switch S5 to the "rise" position places inverter stage transistor Q2 and resistors R28 and R29 in the circuit thus making the signal at the transistor Q2 collector the same for either type input.

Assuming the sample gate to pin 3 to be a positive pulse, with reference to ground, of about 5 ms duration: the input slope switch S5 will be in the "rise" position; a relatively long time has passed before this pulse, thus capacitor C6 in the timing section will be discharged. NPN transistor Q3 will turn on through a bias network of resistors R25 and R24 thereby turning off transistor Q2 which turns off transistor Q1. With S5 in the "fall" position, inverter stage Q2 is removed from the circuit. Resistors R26 and R27 are the bias resistors for transistor Q1. The effect of this circuit is to cause the voltage at the input of amplifier A9 to go from + 6.2 to − 6.2 volts to provide level shift with inversion, (S5 in "rise" position). Both inputs of A9 are connected thereby making A9 an inverter. The voltage at the output of amplifier A9 looks like the input, though going from − 6.2 to + 6.2 volts (see FIG. 4). This gate signal from amplifier A9 is applied to control all four bilateral analog FET switches S1, S2, S3 and S4 which form the circuit switch means. FET switches S1 and S4 are turned on directly while FET switch S3 is turned off by inversion through amplifier A7 and FET switch S2 is turned off by inversion through amplifier A8. After about 5 ms has passed and the input gate falls, the signal at the output of amplifier A9 falls from + 6.2 to − 6.2 volts. This causes FET switches S1 and S4 to turn off directly. FET switch S2 turns on through inversion of amplifier A8. FET switch S3 is held off by the timer until capacitor C6 thereof can discharge through resistor R31 to approximately zero volts. This is the charge sensing mode. Should another sample gate pulse come before timing capacitor C6 has discharged to zero volts, C6 will be recharged and FET switch S3 will remain off. Normal complementary action is not effected on FET switches S1 and S2. Should no sample gate pulse come in about 5 seconds, amplifier A6 (A6 is an inverter with a switch threshold voltage approximately equal to zero) will go low at its output causing amplifier A7 to go high and the output of amplifier A8 to go low. This has the effect of restoring the circuit to the constant current mode by turning off FET switch S2 and turning on FET switch S3.

Figure 4:
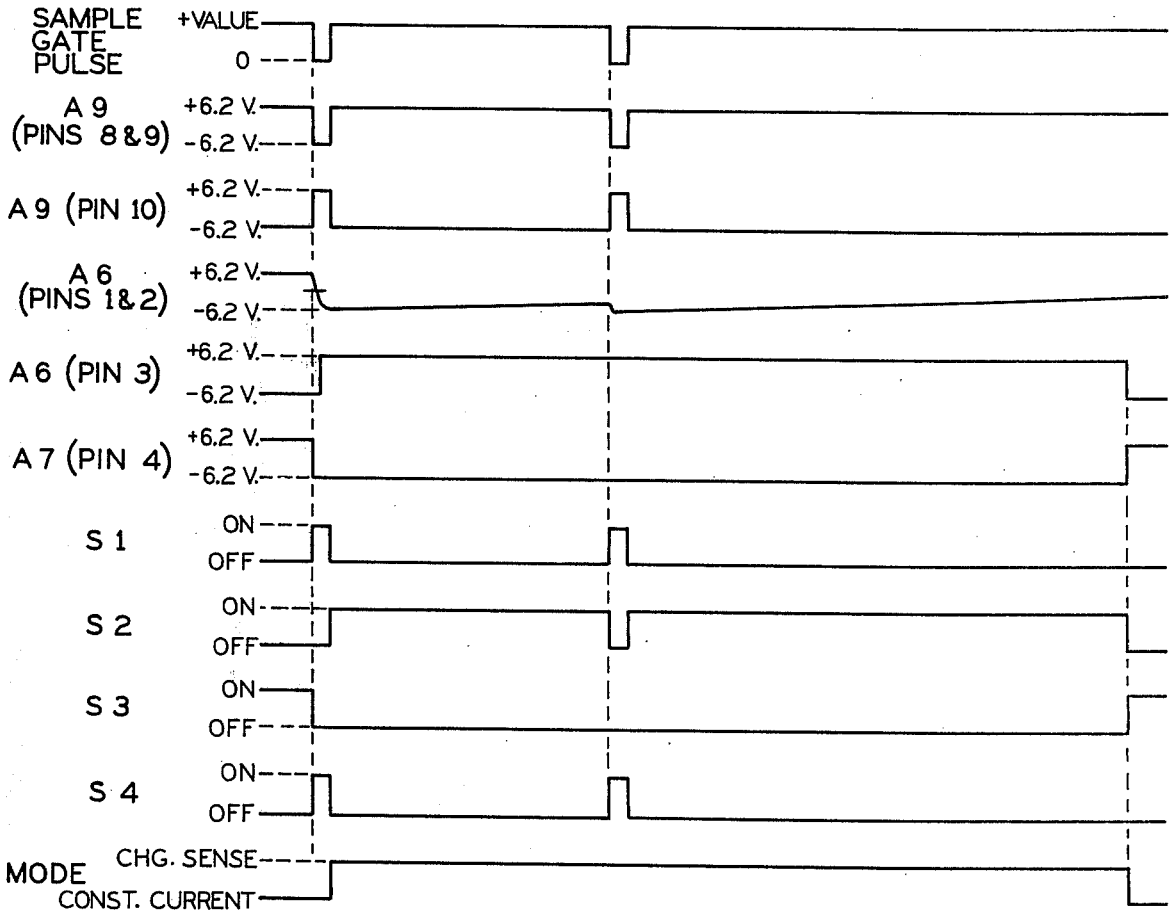
FIG. 4 is a graphic representation of an oscilloscope presentation: a timing diagram.

Timing diagrams for the sample gate processing section and the timer section are shown in FIG. 4, assuming a long off-period, with switch S5 as shown in FIG. 3 with the sample gate voltage at some positive value greater than 2 volts DC, and one repeated sample with a period less than a timer cycle [approximately (R31 × C6) seconds].

The current and charge mode control section is operated by FET switches S1, S2 and S3. As shown in FIG. 4, prior to the first sample, FET switch S3 is the only one on. This places the constant-current mode non time-varying reference voltage $I_{ref}$ (derived from the voltage divided down from the minus 5.6 volt reference by resistors R20, R21 of FIG. 3 and R22 of FIG. 2) on pin 12 of amplifier A5 through FET switch S3, resistor R16, resistor R17 and slow down capacitor C3. Pin 12 is the non-inverting input of high gain differential amplifier A5. Pin 13 of amplifier A5, the inverting input, receives the feedback signal $V_1$ of PR current developed across resistor R44 in FIG. 2 and fed through resistor R35. Resistor R19 limits the DC voltage gain of amplifier A5 while resistor R18 and capacitor C4 are part of the loop stabilization network (A5, R18, R19 and C4 form the summing junction, Σ 3). Amplifier A5 pin 14 is the drive signal $E_{io}$ which is fed forward in the loop so as to force PR current $I_o$ such that the voltage at TP5 is approximately equal to the voltage at TP6 thus regulating PR current per the setting of external current adjust resistor R22.

Upon receipt of the first sample gate pulse at pin 3 of the module 30, FET switch S3 turns off and FET switch S2 stays off. The PR current $I_o$ is held constant by the voltage stored on capacitor C3. As FET switch S1 is turned on, the analog computing circuit (composed of amplifiers A1, A2 and A3 and associated components forming the predictor means) processes the positive electrometer input voltage EV (pin 1) and the negative PR current sense signal $V_1$ (pin 4) so as to compute a new reference for PR current in order to approximate the current required to result in the desired charge: i.e., correct electrometer value. This new reference is stored by charging capacitor C16 to that value through FET switch S1.

The analog computing circuit is comprised generally of three sections: (1) inverting summing amplifier A1, with inputs $V_{ref}$ (− 5.6 volts) and electrometer voltage EV, and input resistors R1, R2, R3 and R4 all forming summing junction Σ 1 and feedback resistor R5 and R6 forming transfer function G1; (2) transfer function G2 including inverting amplifier A2 with unity gain and input resistors R11 and R12 and feedback resistors R13 and R14; (3) inverting summing amplifier A3 with unity gain having as inputs the outputs of (1) and (2) above, input resistors R7, R8 and R9, feedback resistor R10 and high frequency rolloff capacitor C1 to lessen the high frequency noise in the system, all forming summing junction Σ 2.

Forming first analog memory AS1 are capacitor C16, resistor R15, buffer amplifier A4 and capacitor C2. The voltage stored on capacitor C16 is buffered from the load to improve holding drift when FET switch S1 turns off. Amplifier A4 and resistor R15 are connected as a voltage follower to provide this function. Capacitor C2 is used to frequency compensate amplifier A4. Since FET switch S2 is off, no change in the PR current $I_o$ occurs.

Forming second analog memory AS2 are resistor R16, resistor R17 and capacitor C3. Upon the ending of the sample gate, FET switch S1 turns off and FET switch S2 turns on resulting in the new computed value of PR current reference $I_{ref}$, at the end of the sample gate and which is stored on capacitor C16 and transferred to TP5 through FET switch S2.

Resistor R16 and capacitor C3 slow the transition of PR current reference $I_{ref}$ from the old value to the new and the external forward loop circuits react to force PR current $I_o$ to the new value. Upon receiving further sample gate pulses, the process of successive approximation continues to correct PR current $I_o$ so as to maintain a constant desired charge on the photoreceptor. Upon the ending of a sample gate, the timer finishes its cycle and reverts the circuit to the constant current mode.

Diodes D1 and D2 provide clamping action to protect the amplifiers A2 and A5 from damage should a short be placed from the Hi voltage output ($V_o$) to ground. They are normally reverse biased except during fault conditions.

The circuit shown in FIGS. 2 and 3 has been built and operated satisfactorily with the following components and values:

| | |
|---|---|
| Resistors | |
| R1 | 20 K ohms |
| R2 | 91 K ohms |
| R3 | 500 K ohms |
| R4, R9, R15, R17, R24, R25, R35 | 10 K ohms |
| R5, R14 | 20 K ohms |
| R6 | 200 K ohms |
| R7, R8, R10, R11, R23, R26, R27, R28, R29, R30 | 100 K ohms |
| R12 | 47 K ohms |

-continued

| | |
|---|---|
| Resistors | |
| R13 | 91 K ohms |
| R16 | 30 K ohms |
| R18 | 470 K ohms |
| R19, R31 | 4.7 meg. ohms |
| R20 | 75 K ohms |
| R21 | 1.5 K ohms |
| R22 | 25 K ohms |
| R32, R34 | 220 ohms |
| R33 | 1 K ohms |
| R36 | 100 ohms |
| R37 | 15 K ohms |
| R38, R39 | 1 ohm, 2 w |
| R40 | 100 meg. ohms |
| R41 | 75 K ohms, 10 w |
| R42 | 10 K ohms, 2 w |
| R43 | 2.7 K ohms |
| R44 | 16 K ohms |
| R45 | 3.9 K ohms |
| R46 | 2 ohms, 5 w |
| Capacitors | |
| C1, C4 | .01 μf |
| C2 | 30 pf |
| C3 | .47 μf |
| C5 | 50 μf, 50 v. |
| C6, C9 | 2 μf |
| C7, C8 | .04 μf |
| C10, C16 | 1 μf |
| Diodes | |
| D1, D2, D7 | IN 4004 |
| D3, D4 | IN 5059 |
| D5, D6 | ED 5368 (EDI) |
| Zener Diodes | |
| VR1, VR2 | IN 753A |
| VR3 | IN 5232B |
| VR4, VR5 | IN 5243A |
| Transistors | |
| Q1, Q4 | 2N 4248 |
| Q2, Q3 | 2N 3392 |
| Q5 | 60408 |
| Q6, Q7, Q8, Q9 | 2N 3055 |
| Amplifiers | |
| A1, A2, A3, A5 | Monolithic IC LM 324N (N.S.C.) |
| A4 | Monolithic IC LM 308N (N.S.C.) |
| A6, A7, A8, A9 | Monolithic IC CD 4001 AE (RCA) |
| Switches | |
| S1, S2, S3, S4 | Monolithic IC CD 4016 AE (RCA) |

While an embodiment and application of this invention has been shown and described, it will be apparent to those skilled in the art that modifications are possible without departing from the inventive concepts herein described. The invention, therefore, is not to be restricted except as is necessary by the prior art and the spirit of the appended claims.

What is claimed is:

1. A feedback control system comprising:

a first feedback loop including an input reference, a summing junction, a forward transfer function, an output yielding a controlled variable, and a first feedback transfer function for sampling the controlled variable and feeding an output signal proportional to the controlled variable to the summing junction;

a separate transfer function having an input connected to the output of the first feedback loop and producing a system output controlled variable;

a system input reference having as a value the ideal for the system output controlled variable;

a predictor means for sampling the system output controlled variable, the system input reference, and the first feedback loop controlled variable to produce a corrected input reference for the first feedback loop to result in a shift in the first feedback loop output and a corresponding shift in system output controlled variable that will by successive approximation approach a value which is in correct proportion to the system input reference thereby resulting in a near zero system error.

2. The feedback control system of claim 1 wherein the predictor means includes:

a second feedback transfer function for sampling the system output controlled variable to yield a signal proportional thereto; and a system summing junction for receiving the system input reference and comparing it with signal from the second feedback transfer function thence to yield a system error signal.

3. The feedback control system of claim 2 wherein the predictor means further includes:

a third feedback transfer function receiving the output signal from the first feedback transfer function and yielding an output signal proportional thereto;

a predictor summing junction receiving as input the output signal from the third feedback transfer function and comparing it with the system error signal from the system summing junction to yield the corrected input reference for the first feedback loop.

4. The feedback control system of claim 1 further comprising:

a first analog memory for receiving and holding during a sample period the corrected input reference from the predictor means;

a second analog memory for receiving and passing a constant value input reference to the first fedback loop during a sample period, and at sample end for receiving and passing to the first feedback loop the corrected input reference from the first analog memory; and sampling means for gating during the sample period the corrected input reference into the first analog memory while holding the output of the second analog memory constant, and at sample period end, to disconnect the constant value input reference from the second analog memory while gating the contents of the first analog memory, the corrected input reference, into the second analog memory and thence to the first feedback loop.

5. The feeback control system of claim 4 wherein the sampling means includes switch means for disconnecting the predictor means from the first analog memory, for transferring the contents thereof to the second analog memory at the sample end, and for disconnecting the constant value input reference from the second analog memory.

6. A feedback control circuit for an electrostatographic apparatus, the circuit including a first feedback loop having an input reference signal feeding a summing junction, the output of which feeds a high voltage DC to DC link which in turn supplies a charging means, the output of the charging means being a loop output which is measured by a sensing means, the sensing means output being fed back into the summing junction, the circuit further including an electrostatographic imaging surface responsive to the charging means output to become charged, the improvement comprising:

a circuit input reference voltage having as a value the ideal for a voltage proportional to the charge level on the imaging surface;

predictor means including means for sampling the charge level on the imaging surface, means for sampling the circuit input reference voltage and means for sampling the first feedback loop output to predict a new value for the input reference voltage to the first feedback loop to result in a shift in the first feedback loop output and a corresponding shift in the charge level on the imaging surface that will by successive approximation approach a value which is in correct proportion to the circuit input reference voltage thereby resulting in near zero system error.

7. The feedback control circuit of claim 6 wherein the predictor means includes:

means for converting charge on the imaging surface to a voltage proportional to the charge;

a circuit summing junction receiving the circuit input reference voltage and comparing it with the voltage signal from the converting means to produce an error signal.

8. The feedback control circuit of claim 7 wherein the predictor means further includes:

means for amplifying the error signal from the circuit summing junction; and a predictor summing junction receiving the amplified error signal and comparing it with the voltage proportional to the imaging surface charge level to yield the new value for the input reference voltage for the first feedback loop.

9. The feedback control circuit of claim 6 further comprising:

a first analog memory for receiving and holding the new value input reference voltage produced by the predictor means while the circuit is in a charge sensing mode; and a second analog memory for receiving and passing to the first feedback loop from a source a non time-varying reference voltage while the circuit is in a constant current mode and while in the charge sensing mode at sample end for receiving and passing to the first feedback loop the new value input reference voltage from the first analog memory.

10. The feedback control circuit of claim 9 further comprising:

sampling means for gating the new value reference voltage into the first analog memory while the circuit is in the charge sensing mode during a sample period and to disconnect at sample end the non time-varying reference voltage source from the second analog memory while gating the contents of the first analog memory into the second analog memory.

11. The feedback control circuit of claim 10 wherein the sampling means includes switch means for disconnecting the predictor means from the first analog memory and for connecting the output thereof with the input to the second analog memory and for disconnecting the non time-varying reference voltage source from the second analog memory.

12. The feedback control circuit of claim 11 wherein the sampling means further comprises:

timing means and steering logic for controlling the switch means to effect alternately the constant current mode and the charge sensing mode.

13. The feedback control circuit of claim 12 wherein the sampling means periodically receives a sample gate signal as a result of movement of the electrostatographic imaging surface, the sample gate signal serving to initiate the charge sensing mode through processing thereof by the timing means and the steering logic.

14. In an electrostatograpic apparatus having means for non-contact detection of electrostatic charge on a moving electrostatographic imaging surface, a feedback control circuit for producing a charge level on the imaging surface that will by successive approximation approach a value which is in correct proportion to a circuit input reference voltage thereby resulting in near zero circuit error, the circuit comprising:

a first feedback loop having a loop input reference voltage feeding a summing junction, the output of which feeds a high voltage DC to DC link which in turn supplies a means for charging the imaging surface, a voltage proportional to the charge means output being fed back into the summing junction to be compared with the loop input reference voltage;

the circuit input reference voltage having as a value the ideal for the voltage proportional to the charge on the imaging surface;

predictor means including means for sampling the circuit input reference voltage, means for sampling the charge on the imaging surface and means for sampling the voltage proportional to the charging means output to predict a corrected reference voltage for the first feedback loop to result in a shift in the charging means output and a corresponding shift in the charge level on the imaging surface.

15. The feedback control circuit of claim 14 wherein the predictor means includes:

an electrometer for converting charge on the imaging surface to voltage proportional thereto;

a circuit summing junction for receiving the circuit input reference voltage and comparing it with the voltage from the electrometer to produce an error signal.

16. The feedback control circuit of claim 15 wherein the predictor means further includes:

means for amplifying the error signal from the circuit summing junction; and a predictor summing junction receiving the amplified error signal and comparing it with the voltage proportional to the charging means output to yield the corrected reference voltage for the first feedback loop.

17. The feedback control circuit of claim 14 further comprising:

a first analog memory for receiving and holding the corrected reference voltage produced by the predictor means while the circuit is in a charge sensing mode; and a second analog memory for receiving and passing to the first feedback loop from a source a constant value reference voltage while the circuit is in a constant current mode and while in the charge sensing mode at sample end for receiving and passing to the first feedback loop the corrected reference voltage from the first analog memory.

18. The feedback control circuit of claim 17 further comprising:

sampling means for gating while the circuit is in the charge sensing mode the corrected reference voltage into the first analog memory and at sample end to disconnect the constant value reference voltage source from the second analog memory while gating the contents of the first analog memory, the corrected reference voltage, into the second analog memory.

19. The feedback control circuit of claim 18 wherein the sampling means includes switch means for disconnecting the predictor means output from the first analog memory and for connecting the output of the first analog memory with the input to the second analog memory and for disconnecting the constant value reference voltage source from the second analog memory.

20. The feedback control circuit of claim 19 wherein the sampling means further comprises:

timing means and steering logic for controlling the switch means to effect alternately the constant current mode and the charge sensing mode.

21. The feedback control circuit of claim 20 wherein the sampling means periodically receives a sample gate pulse resulting from movement of the moving electrostatographic imaging surface, the sample gate pulse serving to initiate the charge sensing mode through processing thereof by the timing means and the steering logic.

* * * * *